US005598981A

United States Patent [19]

Hellmich

[11] Patent Number: 5,598,981

[45] Date of Patent: Feb. 4, 1997

[54] HAMMERMILL

[75] Inventor: Uwe Hellmich, Hamburg, Germany

[73] Assignee: Sivyer Steel Corporation, Bettendorf, Iowa

[21] Appl. No.: 300,709

[22] Filed: Sep. 2, 1994

[30] Foreign Application Priority Data

Sep. 9, 1993 [DE] Germany ..... 43 30 962.3

[51] Int. Cl.[6] ..... B02C 13/04; B02C 13/28

[52] U.S. Cl. ..... 241/189.1; 241/192; 241/194

[58] Field of Search ..... 241/194, 195, 241/196, 189.1, 192

[56] References Cited

U.S. PATENT DOCUMENTS

| | | | |
|---|---|---|---|
| 1,119,126 | 12/1914 | Sturtevant | 241/192 |
| 1,185,619 | 6/1916 | Blum | 241/192 |
| 1,459,568 | 6/1923 | Blum | 241/192 |
| 2,015,581 | 9/1935 | Armour | 241/195 |
| 3,278,126 | 10/1966 | Ratkowski | 241/195 |
| 3,489,078 | 1/1970 | Oberhellmann | 241/194 |
| 3,727,848 | 4/1973 | Francis | 241/194 |
| 3,844,494 | 10/1974 | Hightower | 241/197 |
| 4,313,575 | 2/1982 | Stepanek | 241/194 |
| 4,650,129 | 3/1987 | Newell et al. | 241/73 |
| 5,072,888 | 12/1991 | Stelk | 241/194 |
| 5,169,077 | 12/1992 | Stelk | 241/194 |
| 5,205,667 | 4/1993 | Montgomery, Sr. | 403/151 |

*Primary Examiner*—John M. Husar
*Attorney, Agent, or Firm*—Foley & Lardner

[57] ABSTRACT

The invention concerns itself with a hammermill, specifically for the fragmentation of metal car bodies, equipped with a shaft to which radially pointing rotor arms are attached, to the ends of which movable hammers are attached in the direction of the shaft rotation. The hammers are individually attached to the rotor arms, are U-shaped and embrace the end and sides of the rotor arms, thereby protecting the rotor arm ends and sides without requiring additional protective caps. On one of the preferred embodiments the positioning of the hammers is configured eccentrically so that an adjustment of the travel circle radii of the hammers is possible allowing greatly extended periods of operation of the hammermill.

9 Claims, 9 Drawing Sheets

HAMMERMILL

FIELD OF THE INVENTION

The invention relates to a hammermill for fragmentation of metal car bodies and more particularly to the individual mounting of the hammers on the ends of the rotor arms.

BACKGROUND OF THE INVENTION

Hammermills of the type contemplated herein are used to break up metal car bodies. These mills, also known as shredders, are fragmentation machines, which meet their objective by impact.

Hammermills possess impact devices that oscillate on the ends of radially directed rotor arms and generally include hammers, taking on a flat position when sufficient torsion speed of the rotor is applied. A well-known configuration features hammers suspended between disks that are affixed to the rotor shaft. Another configuration features a hammer supported between adjacent rotor arms. The hammers are located on a shaft situated parallel to the main shaft, the radial position of this shaft runs through all of the rotor arms and hammers. The number of shafts is equal to the number of the rotor arms to support the hammers.

The hammers are subjected to extraordinary wear and tear and are replaced by new hammers after only a number of days of service. After initial use, some may be reused after having been shifted 180°. Yet, the production period of such a hammermill is relatively short. The free standing ends of the rotor arms in this type of hammermill are also subject to wear. Attempts have been made to fit the rotor arm ends with protective caps that are also attached to the shaft that supports the hammers. Finally, it is worth noting that the frequent exchange of hammers and protective caps requires the disassembly of the full length of the supporting rod.

In the hammermills disclosed and described in U.S. Pat. No. 4,313,575 and U.S. Pat. No. 3,844,494 the supporting rods for the protective caps and the supporting rod for the hammers are situated behind each other in circumferential direction. Thus, the front edges of the rotor arms, especially exposed to wear, are protected by the caps. Even though these configurations do not require the dismantling of the hammers in order to change the protective caps, a costly supplemental arrangement is required to secure the caps to the rotor arms.

SUMMARY OF THE PRESENT INVENTION

One of the primary objects of this invention is the construction of a hammermill, specifically for the fragmentation of metal car bodies, which requires few parts and low maintenance, yet possesses a long service period.

The hammermill according to the present invention is provided with U-shaped hammers which are attached to the rotor arms and embrace the ends of the rotor arms. This configuration first makes it possible for the hammers to be attached independent of the adjacent rotor arms or hammers, and second makes the supplementary use of protecting caps unnecessary because of the U-shape of the hammers. Not only is the number of necessary parts greatly reduced, but this configuration avoids the wear of protecting caps and their exchange.

One of the primary advantages of mounting the hammers at the ends of the rotor arms is that the ends of the arms are spared all impact and are kept free of wear in contrast with the hammers contact with the anvil.

A further advantage of the hammers according to the present invention, depending on their wear, is that the hammers can be exchanged or turned around individually. This procedure eliminates the space and effort required for the installation and deinstallation of hammers that are supported by one common shaft.

Another advantage of the present invention is that the hammers are pivotally mounted at the end of a rotor arm by a supporting rod around which the hammer is allowed to pivot.

A preferred configuration of the invention features a supporting rod having an eccentric member mounted on each end which is rotatable about the axis of the supporting rod, whereby the supporting rod can be rotated to change the position of the hammer on the rod. This configuration allows the hammer to slide in the longitudinal direction of the rotor axis when the supporting rod is turned. This eccentric support of the hammer, therefore, allows repositioning of the hammer in the longitudinal direction of the rotor arm after a certain period of wear. Proportionally to the eccentricity of the position of the eccentric members on the supporting rod, a longer service period can be achieved for the hammer. The radial alignment can be set individually for each hammer. The procedure is simple, and the varying degrees of wear in the axial direction of the hammermill can be dealt with. An exchange of a hammer is not necessary until the hammer is completely spent in the farthest radial position. Due to the construction of the hammermill, such an exchange can be done "locally."

Another advantage of the invention is the ability to adjust the eccentric members to change the radial setting of the hammers which make it possible to adjust the gap separation between the fly circle of the hammers and the impact receptacle onto the material to be fragmented.

Preferably, the supporting rod consists of two half rods, the eccentric members of which are positioned to engage the shanks of the U-shaped hammers. The half rods can then be fastened to the end of the rotor arm with screws, which are inserted from the side through the shank of the hammer. To prevent the supporting rods from turning, they preferably are connected to the end of the rotor arm by adjusting springs.

The supporting rod can be fastened in at least two positions with respect to the rotor arm. If more than two positions are desired, more adjusting spring connections will facilitate this change. Instead of an adjusting spring connection, a multiple edge configuration of the supporting rod can be employed which is inserted into a corresponding opening of the rotor arm.

The rotor arms are preferably configured as rotor pairs, and are fastened to the main shaft in an arrangement of 90° adjoining each other. On the circumference, therefore, four rows of hammers are arranged. Instead of pairs, these can also be configured in triplicate so that six rows of hammers are aligned on the circumference. The configuration of the rotor arms on the end of the main shaft can also be arranged as a single rotor arm. The invention has the advantage that only as many rotor arms as are necessary as hammers are provided.

The width of the hammers in the direction of the axis of the main shaft corresponds to the distance between adjacent rotor arms. However, the hammers can be of broader width so that overlap of the track of travel of adjoining hammers results.

Preferably, the rotor arms are fastened to the main shaft, the diameter of which tapers, by means of adjusting springs to prevent turning, while all rotor arms are connected with each other in the axial direction of the main shaft by tie rods.

Other principal features and advantages of the invention will become apparent to those skilled in the art upon review of the following drawings, the detailed description and the appended claims.

Figure 1:
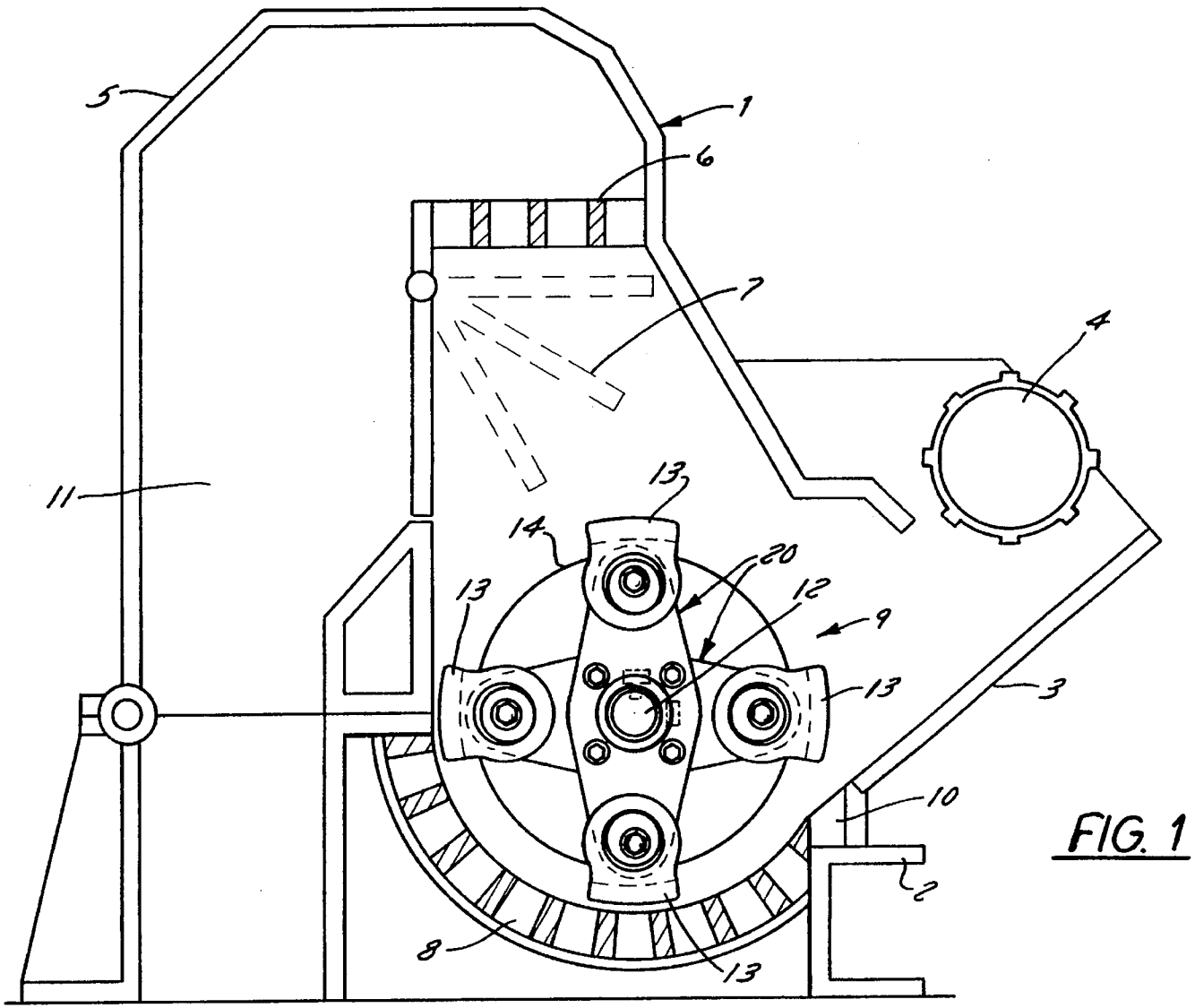
FIG. 1 is a cross section view of the hammermill having a four arm rotor.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

A hammermill 1 according to the present invention is shown mounted on a housing 2. A rotor assembly 9 is mounted on a shaft 12 located in housing 2. The rotor assembly consists of two pairs of rotor arms to the ends of which pivoting hammers 13 are attached. Below the rotor assembly 9 an impact receptacle 8 is positioned. The material to be fragmented is transported to an anvil 10 by way of an input chute 3 and a feeding roller 4, where it is broken down by the hammers 13. The material to be fragmented may be car bodies, scrap iron or even rock. The fragmented material is passed on through the impact receptacle 8 or through a grate 6, fitted with a flap 7, via the feed head 5 into the exit passage 11.

Figure 2:
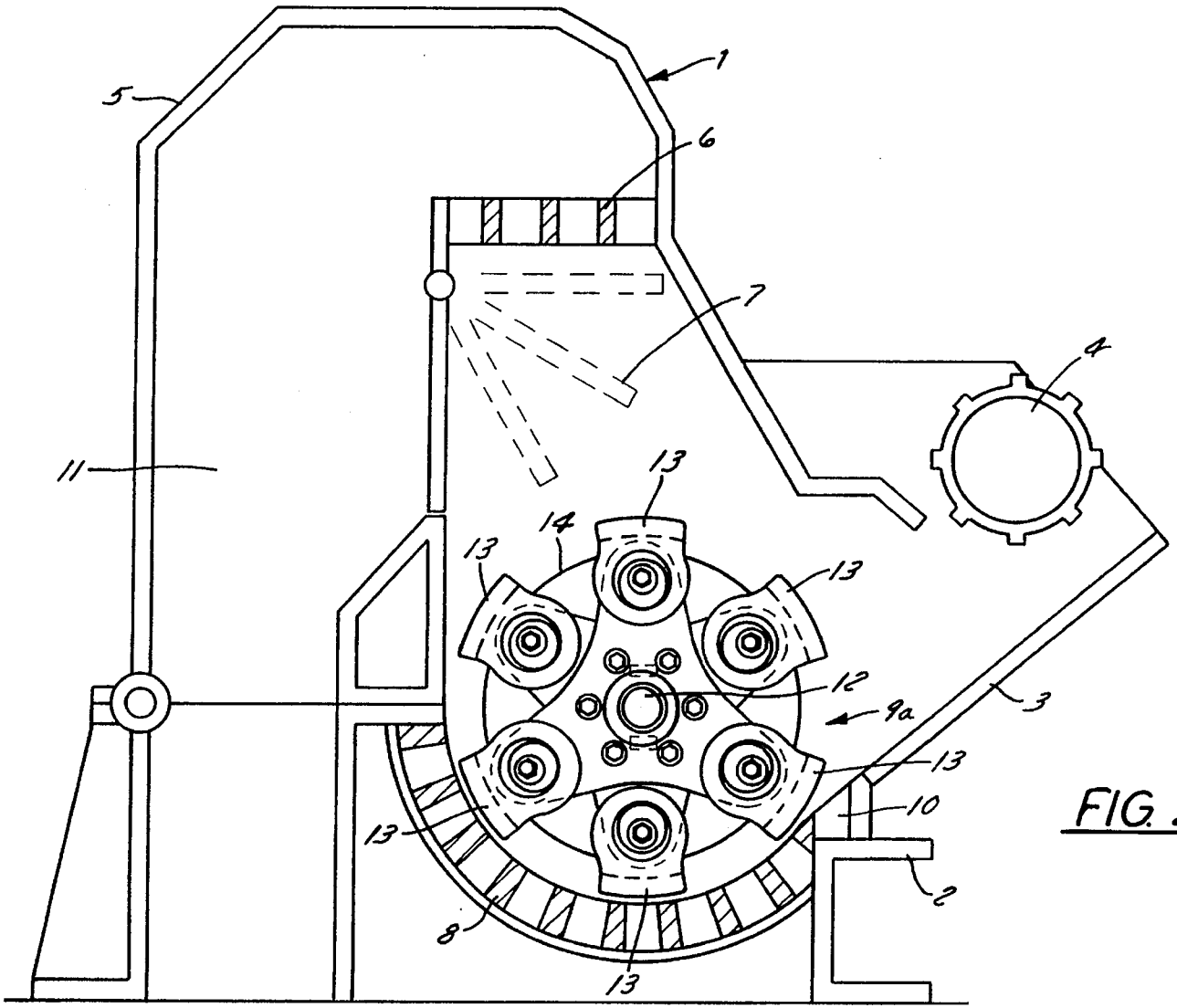
FIG. 2 is a cross section view of a hammermill having a six arm rotor.

A hammermill 1 of the same basic design is shown in FIG. 2 which includes a six arm rotary assembly 9*a*.

Figure 3:
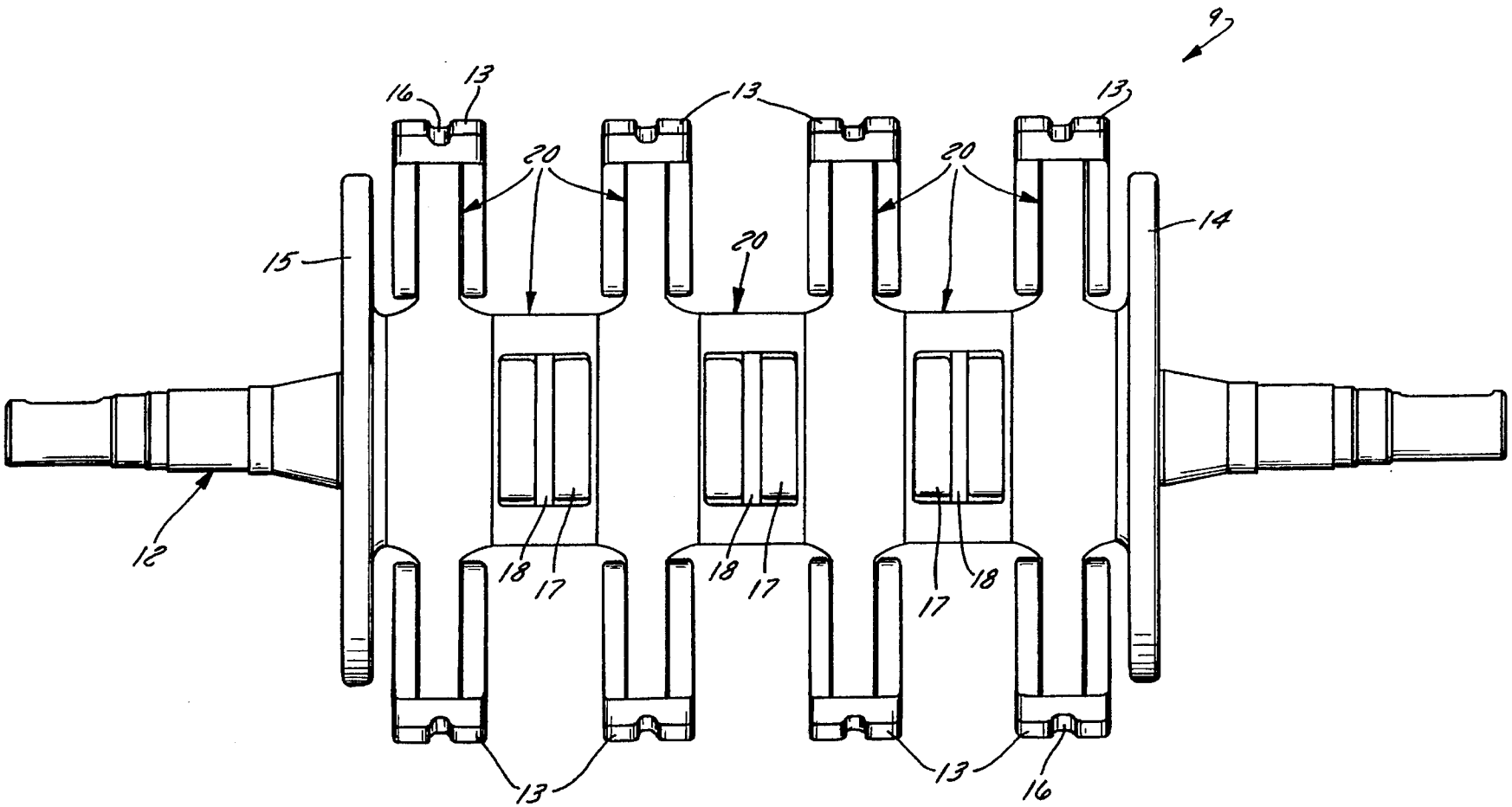
FIG. 3 is a side view of the rotor assembly.

A side view of the rotor assembly 9 is shown in FIG. 3 which includes a shaft 12 having seven pairs of rotor arms 20, while vertical therewith the upper sides of three additional arms are to be noted. The rotor assembly 9 is constrained on each end by end plates 14, 15.

The radially protruding ends of the rotor arms 20 are equipped with U-shaped hammers 13 and 17, which are single-jointedly connected to the rotor arms. The hammers have recesses or grooves 16 and 18 on their outer surfaces which are aligned in the circumferential direction of the rotor, and which serve to improve the fragmentation result.

Figure 4:
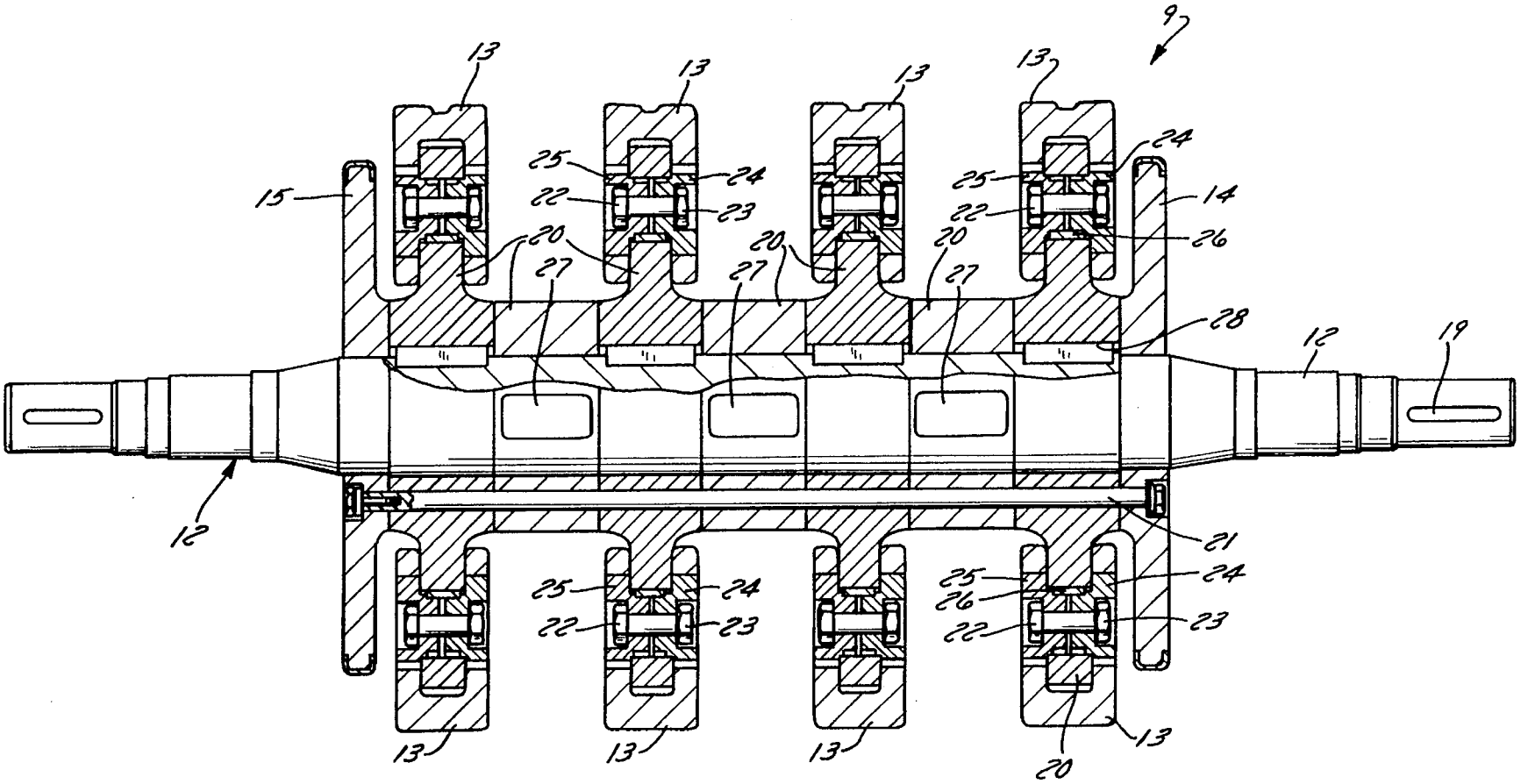
FIG. 4 is a cross section view of the rotor assembly shown in FIG. 3.

Referring to FIG. 4 a cross section of the rotor assembly 9 is shown which includes a main shaft 12 having seven rotor assemblies 20 mounted thereon. Recesses 27 are provided at spaced intervals along the length of the shaft 12. Corresponding recesses 28 are provided in the rotor assemblies 20. Keys are provided in the recesses 27 and 28 to connect the rotor arms to the rotor. The shaft 12 is connected to the motor by an adjusting key connection 19. All of the rotor arms 20 and end plates 14 and 15 are connected by one or more tie rods 21 that are distributed over the circumference of the shaft.

As shown in FIGS. 5, 6, 7 and 8, at the end of each rotor arm 20 a U-shaped hammer 13 is attached that encloses the end of the rotor arm 20. The hammers 13 are secured to the rotor arms 20 by means of eccentric rods 24 and 25 which support the hammer 13 and thus allow the hammer to move at the end of the rotor arm. The rods 24 and 25 are fastened to both sides of the rotor arm by a screw bolt 22 and a nut 23. An adjusting key 26 keeps the eccentric rods from turning against themselves in the rotor arm.

Figure 5:
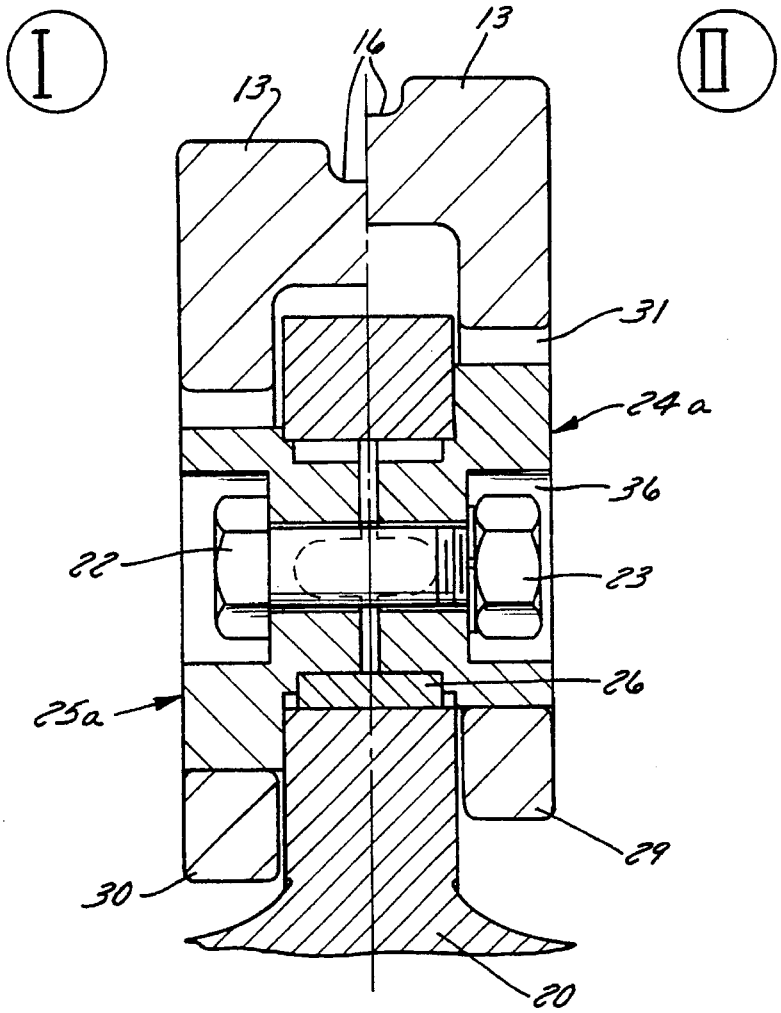
FIG. 5 is a cross section view showing the two positions of the hammer mounted on the rotor.

FIG. 5 shows a hammer 13 mounted on the end of a partial rotor arm 20. To demonstrate the possible adjustment of the hammer, on the left side "I" a hammer is shown in a position with the smallest travel radius. On the right side "II" a hammer is shown in position with the largest travel radius.

The hammer 13 includes two U-shaped shanks 29 and 30 that enclose the sides of the rotor arm 20. The shanks 29 and 30 serve to secure the hammer on the rotor arm and simultaneously protect the end of the rotor arm. The eccentric rods 24 and 25 are fastened in the bore hole 31 at the end of each rotor arm by the screw 22 and the nut 23. The eccentric rod assembly consists of two half-axles 24 and 25, which exhibit suitable gradations at their opposing inner surfaces so that a small gap results between the half-axles 24 and 25 when the half-axles 24 and 25 are fastened at the end of the rotor arm. To prevent turning, an adjusting key 26 is connected between the rotor arm end and the two half-axles 24 and 25.

The axes of the outer cylindrical members 24*a* and 25*a* rotate eccentrically to the axes of the half-axles 24 and 25. The cylindrical members 24*a* and 25*a* are positioned in the bore holes 31 in the shanks of the hammer. As shown on the left side of FIG. 5, the positioning of the cylindrical member 25*a* results in a travel circle at the outer end of the hammer 13 that is smaller than the travel circle of the outer end of the hammer 13, if the cylindrical members 24*a* and 25*a* are positioned as shown on the right side of FIG. 5. Depending on how the half-axles 24 and 25 are turned in the bore hole 31 of the rotor 20, a different travel circle radius of the outer end of the hammer 13 results. As opposed to the rotor arm 20, the half-axles 24 and 25 as shown in FIGS.9,10, and 11, feature several adjusting key turn positions 2*a*, 2*b*, 2*c* and 2*d* which allow for a corresponding number of positions of the hammer at the end of the rotor arm.

In practical application, generally two positions of the half-axles 24 and 25 are employed, namely a starting position with the smallest travel circle radius of the hammer, as shown on the right side of FIG. 5, so that the initial travel circle radius, as shown on the left side of FIG. 5, can again be attained.

Figure 6:
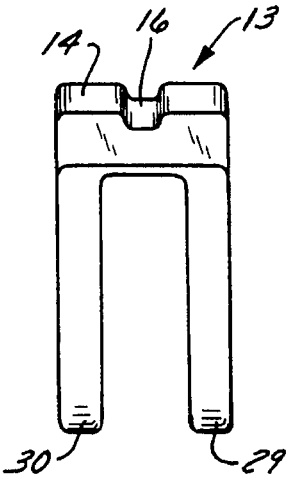
FIG. 6 is a side view of the hammer.
Figure 7:
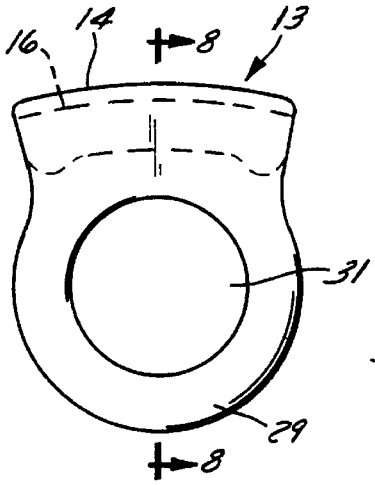
FIG. 7 is a view of the front or of the back of the hammer.
Figure 8:
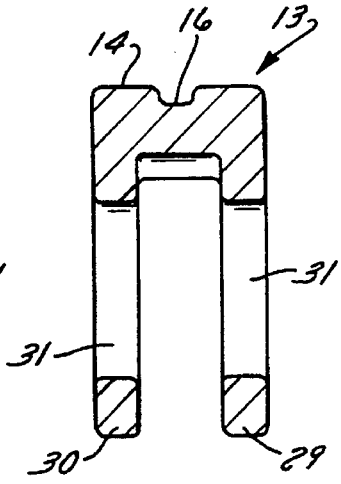
FIG. 8 is a cross section of the hammer, taken on line 8—8 of FIG. 7.

As shown in FIG. 5 the screw bolt and nut 22 and 23 are protected in that the screw head and/or the nut, respectively, are located in recesses 36 in the half-axles 24. Referring to FIGS. 6, 7 and 8, a U-shaped hammer 13 is shown which includes a head 14 and a pair of shanks 29 and 30. A groove 16 is provided on the upper surface of the head 14. The hammer 13 is identical, front and back, and includes a bore hole 31 in the shanks 29 and 30.

Figure 9:
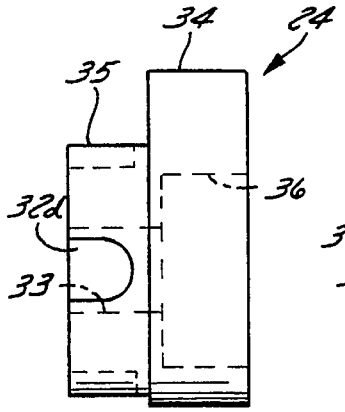
FIG. 9 is a view of one-half of the supporting rod.
Figure 10:
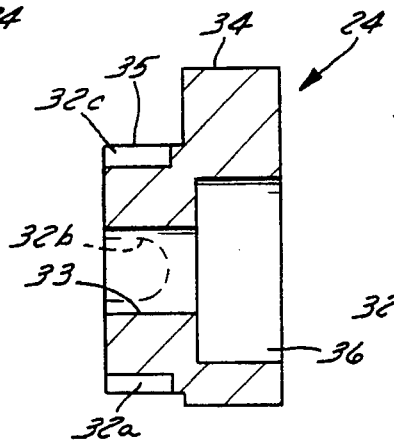
FIG. 10 is a cross section view of the supporting rod taken on line 10—10 of FIG. 11.
Figure 11:
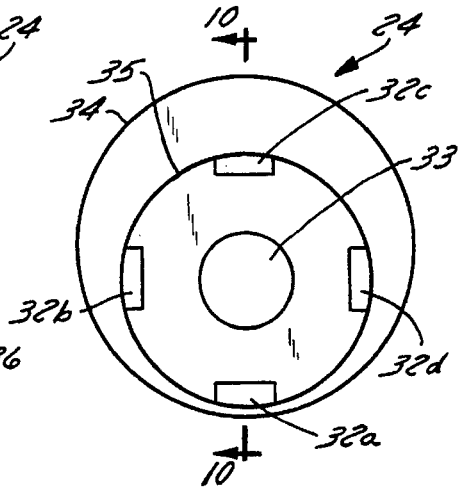
FIG. 11 is a view of the supporting rod.

Referring to FIGS. 9, 10 and 11, one of the eccentric members 24 is shown which shows that the axes of the cylindrical members of the half-axle 24 have a greater circumferential travel eccentrically to the axis of the inner area of the half-axle 24 which has a smaller circumference. The recesses 32 shown in the perimeter of the half-axle serve as an adjusting spring notch to secure the half-axle 24 in the rotor arm end.

The half-axle 24 as shown in FIG. 11 is located in an eccentric relation to the outer circumference 34. The illustration shows four adjusting key recesses 32 staggered at 90°, thus allowing a setting of the half-axle 24 which renders possible two different travel circle radii of the hammer.

Figure 12:
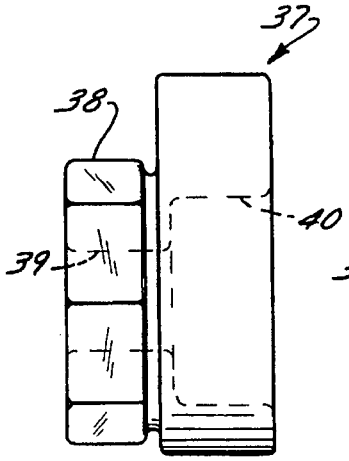
FIG. 12 is a side view of an alternate embodiment of the supporting rod.
Figure 13:
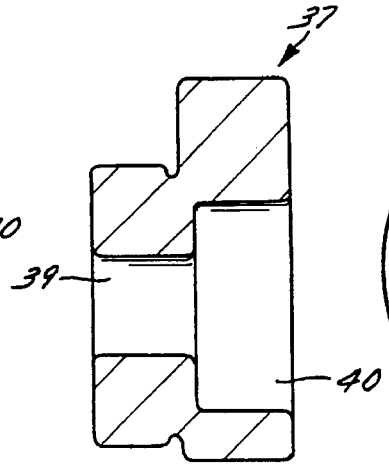
FIG. 13 is a cross section view of the supporting rod taken on line 13—13 of FIG. 14.
Figure 14:
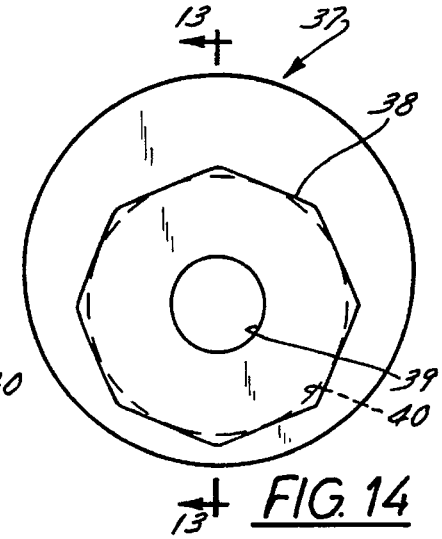
FIG. 14 is a view of the back of the supporting rod of FIG. 12.

An alternative configuration of the eccentric member 37 is shown in FIGS. 12, 13 and 14. The surface of the half-axle 38 features an octagon configuration, as shown in FIG. 14. FIG. 13 shows the corresponding cross section of the bore hole 39 and the recess 40. This configuration allows, with corresponding forming of the bore hole 31 in the end of the rotor arm, the setting for four travel circle radii, whereby no adjusting keys are needed to prevent the half-axle 38 from turning opposite to the end of the rotor arm. The fastening of the rotor arm end is accomplished by a screw connection through the bore hole 39.

Figure 15:
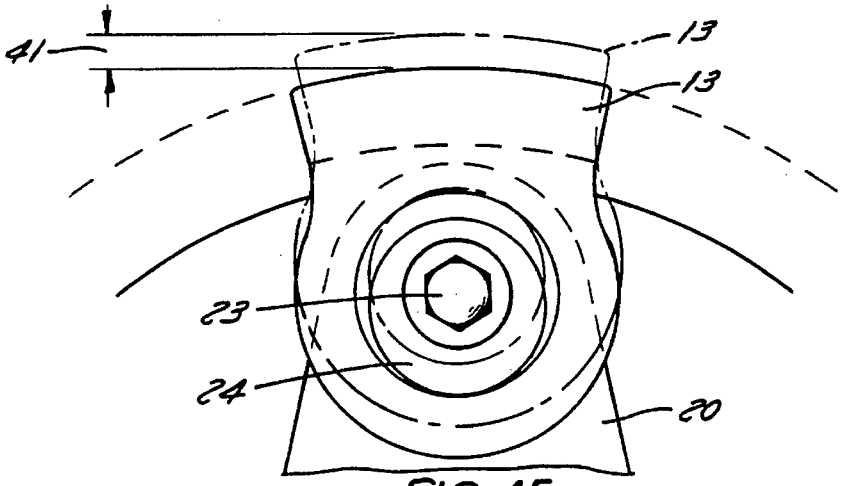
FIG. 15 is a view of the track of travel of a hammer shown in the two positions of the supporting rod.

FIG. 15 is a side view of a rotor arm 20 having a hammer 13 mounted thereon. The radius of the two travel circles differs by the setting height 41. An initial setting that attains the inner travel circle radius can, after a certain amount of hammer surface wear, be reattained by radial repositioning of the hammer 13 at the rotor arm end by turning the half-axle 24 upon loosening the screw connection 23. This increases the service period and heightens productivity.

Figure 16:
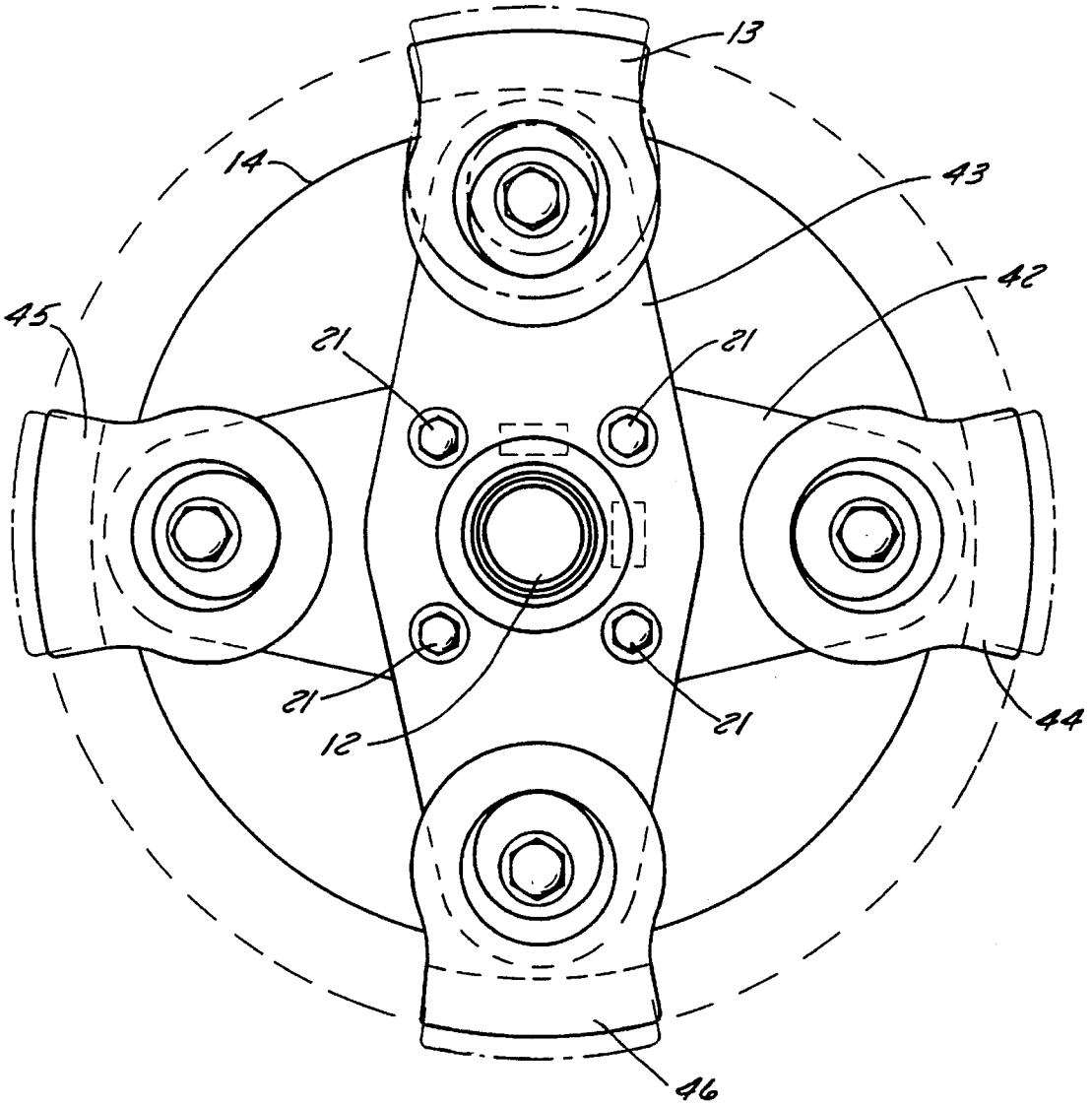
FIG. 16 is a front view of a four arm rotor.

An end view of a rotor assembly 9 is shown in FIG. 16 which includes a shaft 12 to which rotor arm pairs 42 and 43 are attached. The rotor arm ends carry hammers 13 and 44–46. Four tie rods 21 connect all rotor arm pairs positioned adjacently.

Figure 17:
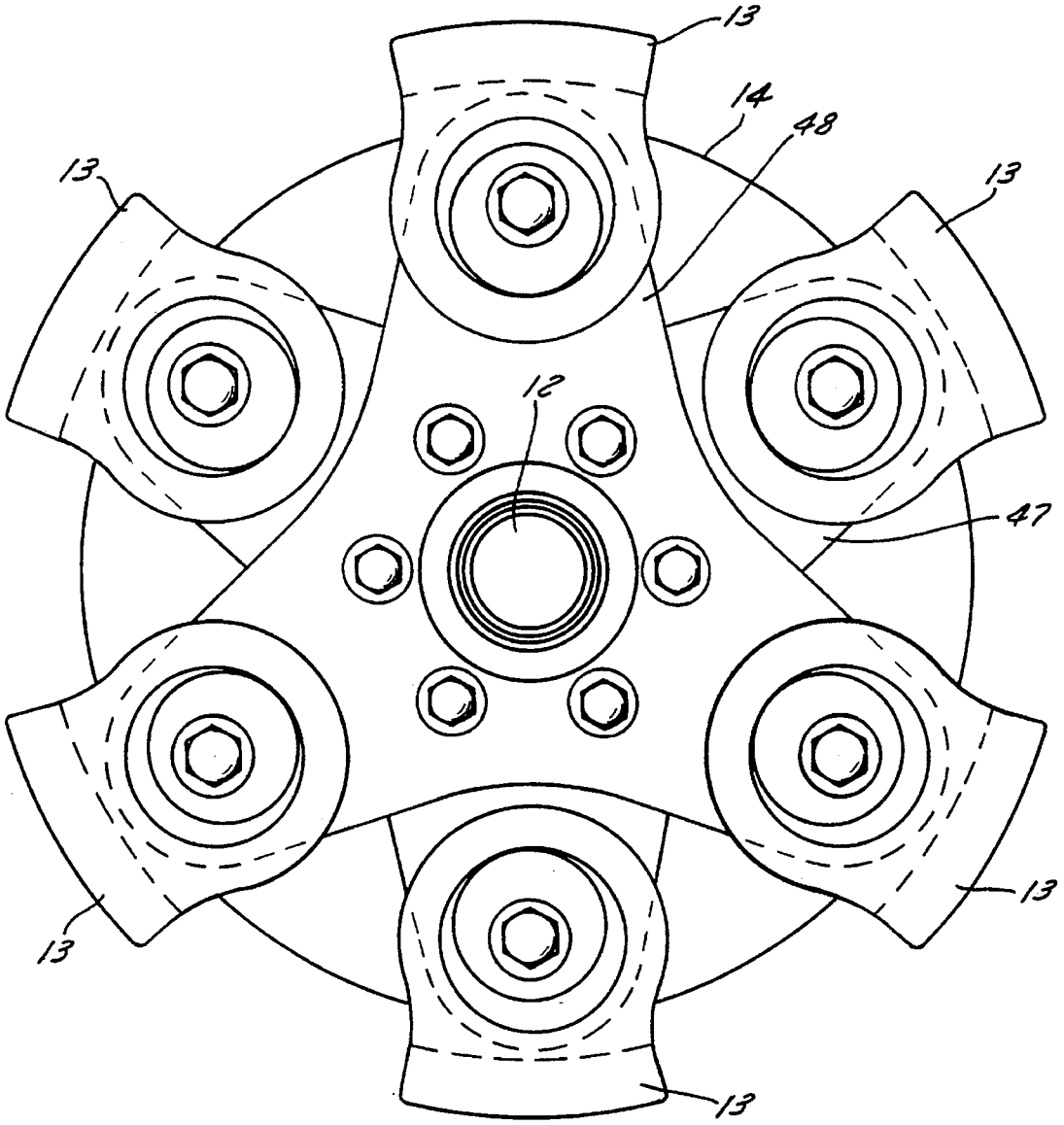
FIG. 17 is a front view of a six arm rotor.

An alternative hammer assembly is shown in FIG. 17 which includes a rotor having three rotor arms 47 and 48 that carry a hammer 13 at the end of each rotor arm. At the same rotating speed of the rotor, a 50% increase in impact count is thereby achieved.

Figure 18:
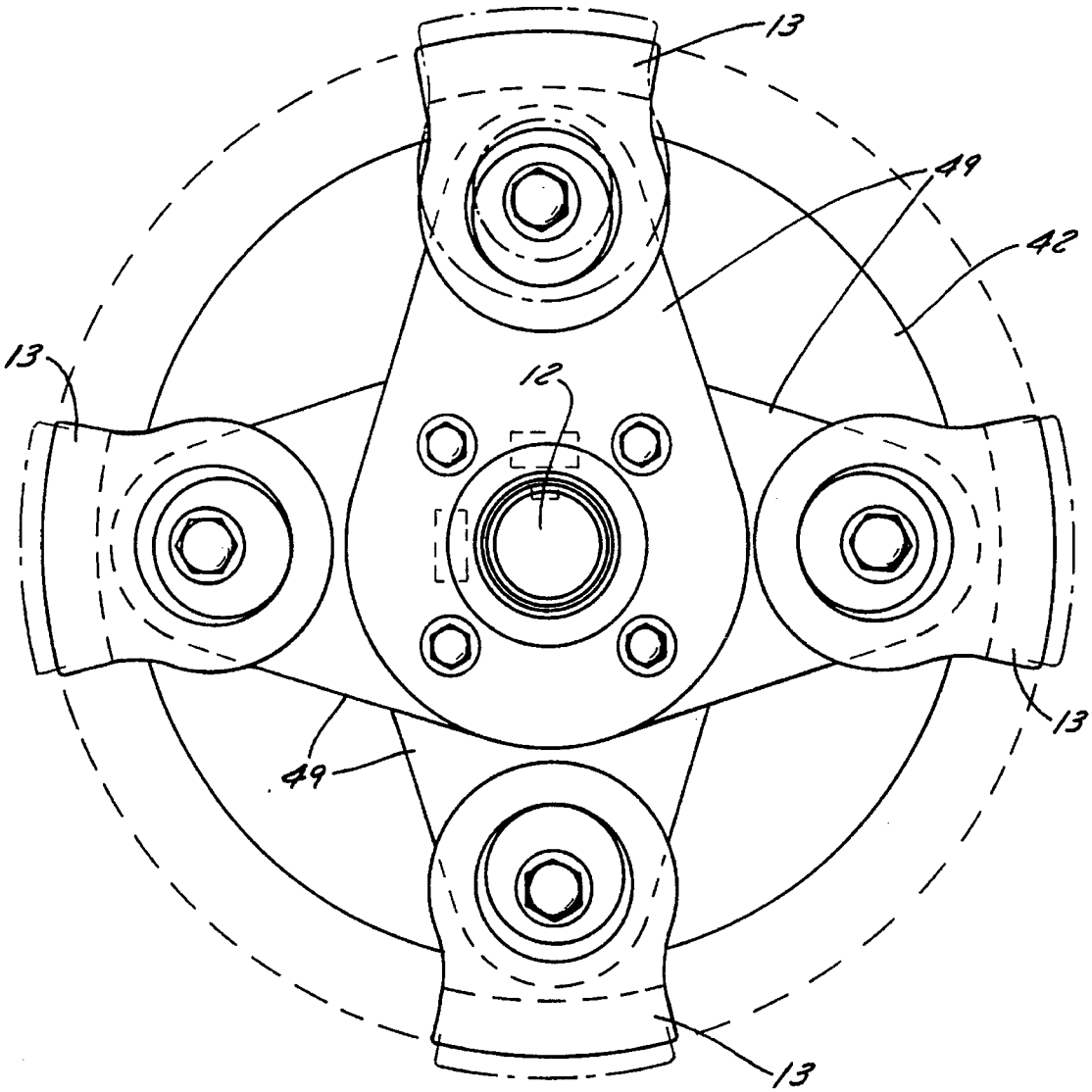
FIG. 18 is a front view of a four arm rotor with a one arm end rotor.

FIG. 18 shows a rotor configuration where the end rotor arm 49 is the only arm.

There exists the option that the width of the hammers, which generally corresponds to the sequential distance between two successive rotor arms on the shaft, can be selected to be larger in order to achieve overlap of the impact area of successive hammer blows, whereby the fragmentation result for certain material can be increased.

If the adjustability of the hammers is not desired, there is no need to use adjustable supporting rods. In this case, the hammers can be linked directly with the ends of the rotor arms by means of a single pin connection. The U-shape or clasplike configuration of the hammers can further be improved by the curved shape of the base of the hammer that faces the rotor arm end in order to afford additional protection to the rotor arm end in the circumferential direction of the rotor. Even though the pivotability of the hammer is thereby limited, in practical application this is of little importance since, based on the high count of rotor revolutions when impacting the material to be fragmented, generally only a slight deflection of the hammer takes place.

The number of rotor arms on the shaft can vary. Since individual hammers are attached to the rotor arm ends, hammermills can be constructed featuring greater lengths than conventional hammermills where group attachment of all hammers along a single shaft leads to operational difficulties.

In addition to the use of adjusting spring links or multiple cornered connections to prevent the half-axles from turning, any other state of the art securing device is suitable.

Thus, it should be apparent that there has been provided in accordance with the present invention a hammermill that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A hammermill for the fragmentation of metal car bodies, comprising:

a housing, a shaft situated in said housing, a number of radially directed rotor arms mounted on said shaft, a hammer aligned with the end of each rotor arm which moves in the direction of the shaft rotation, and means for independently mounting the hammers on each of the rotor arms, each hammer having a pair of U-shaped shanks pivotally mounted on said mounting means for enclosing the sides of the rotor arms.

2. The hammermill according to claim 1, wherein said mounting means comprises a rod positioned parallel to the shaft and a cylindrical member eccentrically mounted on each end of the rod for adjusting the radial position of the hammer with respect to the shaft.

3. The hammermill according to claim 1, wherein each of the shanks includes a bore hole and said cylindrical members fit into the bore holes provided in the shanks of the hammer.

4. The hammermill according to claim 3, wherein each of the rods includes two half axles each having a cylindrical member eccentrically mounted on the outer end of each of the half axles.

5. A hammermill for the fragmentation of car bodies, said hammermill comprising:

a housing, a shaft mounted for rotary motion in said housing, a number of radially directed arms mounted on said shaft, an eccentric rod assembly mounted on the end of each of the arms, and a U-shaped hammer mounted on the eccentric rod assembly on the end of each of said arms to enclose the end of the arm whereby the radial position of the hammers can be adjusted by rotating the rod assemblies to compensate for wear on the face of the hammers.

6. The hammermill according to claim 5 wherein each of said rod assemblies includes a rod and a cylindrical member eccentrically mounted on each end of the rod and said hammers include a pair of shanks having openings therein for matingly engaging the cylindrical members on said rods.

7. The hammermill according to claim 6 wherein said eccentric rods are split into half sections and a nut and bolt assembly for securing said half sections to said rotor arms.

8. A hammermill comprising:

a housing, a shaft mounted for rotary motion in said housing, a number of radially directed rotor arms mounted on said shaft;

a hammer mounted on the outer end of each of said arms and a rod mounted on the end of each arm for supporting said hammers for pivotal motion on the end of said arms, each of said hammers including an opening on each side and a cylindrical member eccentrically mounted on each end of said supporting rod for matingly engaging said openings, wherein the radial position of the hammer can be adjusted by rotating the cylindrical member to compensate for wear on the face of the hammer.

9. The hammermill according to claim 8 wherein said supporting rods are split and further including means for securing said rods to the arms.

* * * * *